US006481725B2

(12) United States Patent
Chou

(10) Patent No.: US 6,481,725 B2
(45) Date of Patent: Nov. 19, 2002

(54) SKATEBOARD AND SKI ARRANGEMENT

(76) Inventor: Windsor Chou, 2/F, No. 205, Hsinlung Rd., Sec. 2, Taipei City (TW)

( * ) Notice: Subject to any disclaimer, the term of this patent is extended or adjusted under 35 U.S.C. 154(b) by 0 days.

(21) Appl. No.: 10/029,156

(22) Filed: Dec. 31, 2001

(65) Prior Publication Data

US 2002/0043774 A1 Apr. 18, 2002

(51) Int. Cl.[7] ..... A63C 17/18
(52) U.S. Cl. ..... 280/7.14; 280/14.21; 280/87.042
(58) Field of Search ..... 280/7.12, 7.13, 280/7.14, 7.15, 14.21, 14.25, 14.26, 14.27, 26, 28, 87.041, 87.042, 87.05

(56) References Cited

U.S. PATENT DOCUMENTS 4,116,455 A * 9/1978 Dotson et al. ..... 280/7.14
4,138,128 A * 2/1979 Criss ..... 280/14.26
4,161,323 A * 7/1979 Wetteland ..... 280/7.12
4,163,565 A * 8/1979 Weber ..... 280/7.13
4,194,753 A * 3/1980 Schrishuhn, Jr. ..... 280/7.12
4,896,893 A * 1/1990 Shunays et al. ..... 280/7.14
5,161,810 A * 11/1992 DeCesare ..... 280/14.21
5,249,816 A * 10/1993 Southworth ..... 280/14.21

* cited by examiner

*Primary Examiner*—Michael Mar
(74) *Attorney, Agent, or Firm*—Rosenberg, Klein & Lee

(57) ABSTRACT

A combined skateboard and ski which includes a body board having two bottom riser pads, a ski, and cushions. Lock nuts and two mounting frames are provided on a top side of the ski for securing the ski to the riser pads of the body board. Each of the mounting frames has a support arm and a pivot hole formed in the support arm. Two wheel assemblies are fastened to the riser pads of the body board by cushions and lock nuts to form a skateboard after removal of the mounting frames from the riser pads.

3 Claims, 4 Drawing Sheets

SKATEBOARD AND SKI ARRANGEMENT

BACKGROUND OF THE INVENTION

1. Field of the Invention

The present invention relates to a skateboard and ski arrangement, which enables a skateboard to be detachably fastened to a ski for sliding over snow.

2. Description of the Related Art

A regular ski, as shown in FIGS. 6 and 7, comprises a skiing board 3, a footplate 4, and two mounting structures 5 that connect the footplate 4 to the skiing board 3. Each mounting structure 5 comprises a first mounting frame 51 fixedly provided at the bottom side of the footplate 4, a second mounting frame 52 fixedly provided at the top side of the skiing board 3, and a pivot bolt 53 adapted to secure the first mounting frame 51 to the second mounting frame 52. The ski can simply be used for sliding over snow. For skating over a hard smooth surface, a skateboard may be used. It is expensive to prepare a skateboard and a ski for different purposes. Further, it requires much storage space to keep a skateboard and a ski when not in use.

SUMMARY OF THE INVENTION

The present invention has been accomplished under the circumstances in view. It is the main object of the present invention to provide a skateboard and ski arrangement, which enables the user to use the skateboard for skating over a hard smooth surface, or to fasten the skateboard to a ski for sliding over snow. According to the present invention, the skateboard and ski arrangement comprises a board body having two bottom riser pads, a ski, cushions and lock nuts two mounting frames fixedly provided at a top side of the ski and adapted for securing the ski to the riser pads of the board body by the cushions and the lock nuts, said mounting frames each comprising a support arm, a pivot hole disposed in said support arm and adapted for receiving the threaded pivot of one riser pad of said board body, and two wheel assemblies adapted for fastening to the riser pads of the board body by the cushions and the lock nuts to form with the board body a skateboard after removal of the mounting frames from the riser pads.

DETAILED DESCRIPTION OF THE PREFERRED EMBODIMENT

Figure 2:
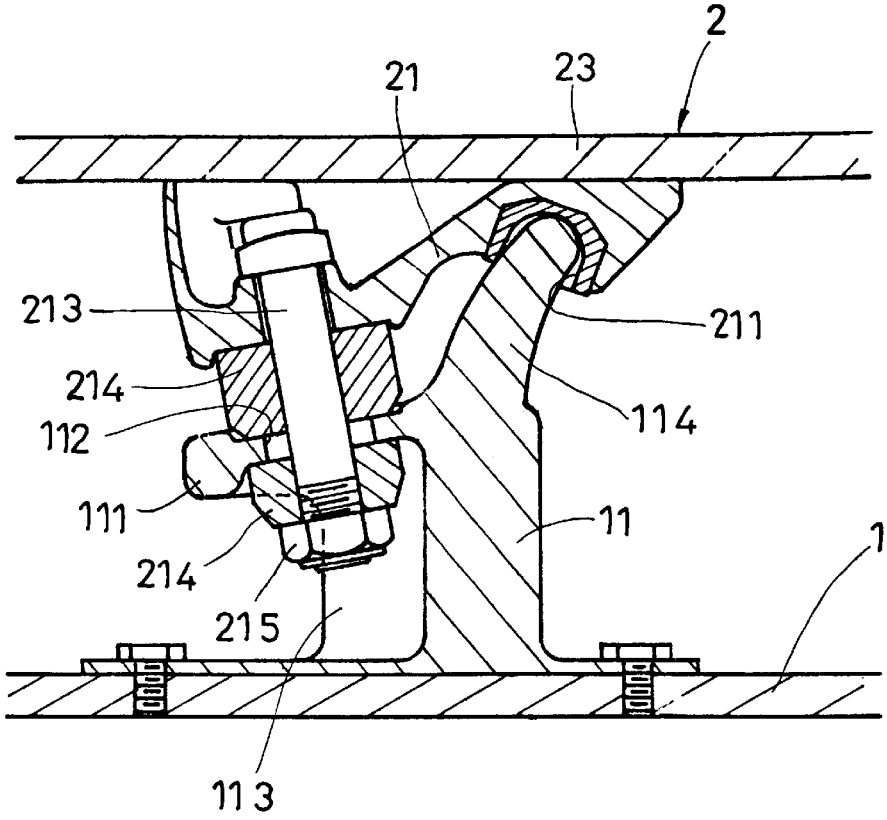
FIG. 2 is a sectional view showing the riser pad of the board body fastened to the corresponding mounting frame of the ski according to the present invention.
Figure 1:
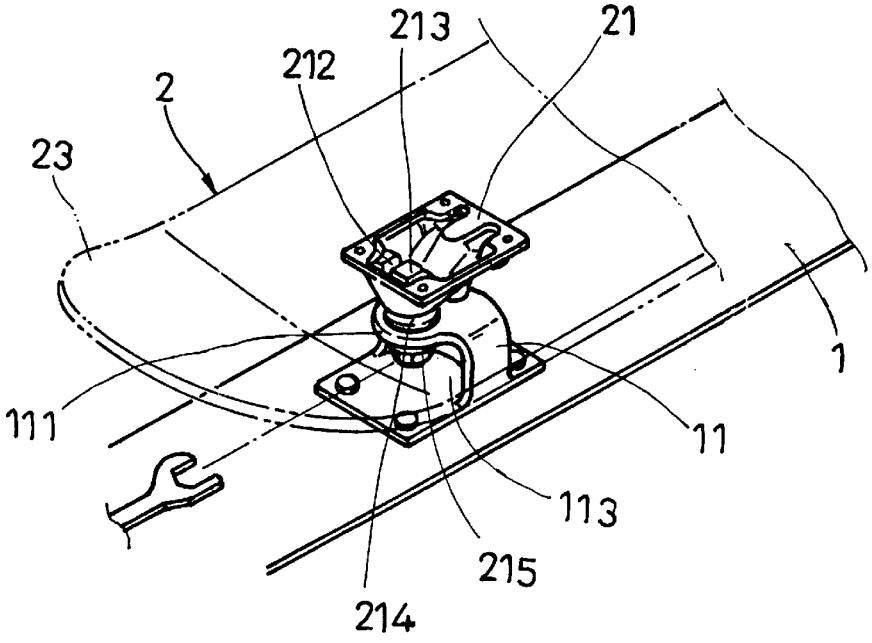
FIG. 1 is a perspective view showing the riser pad of the board body fastened to the corresponding mounting frame of the ski according to the present invention.
Figure 3:
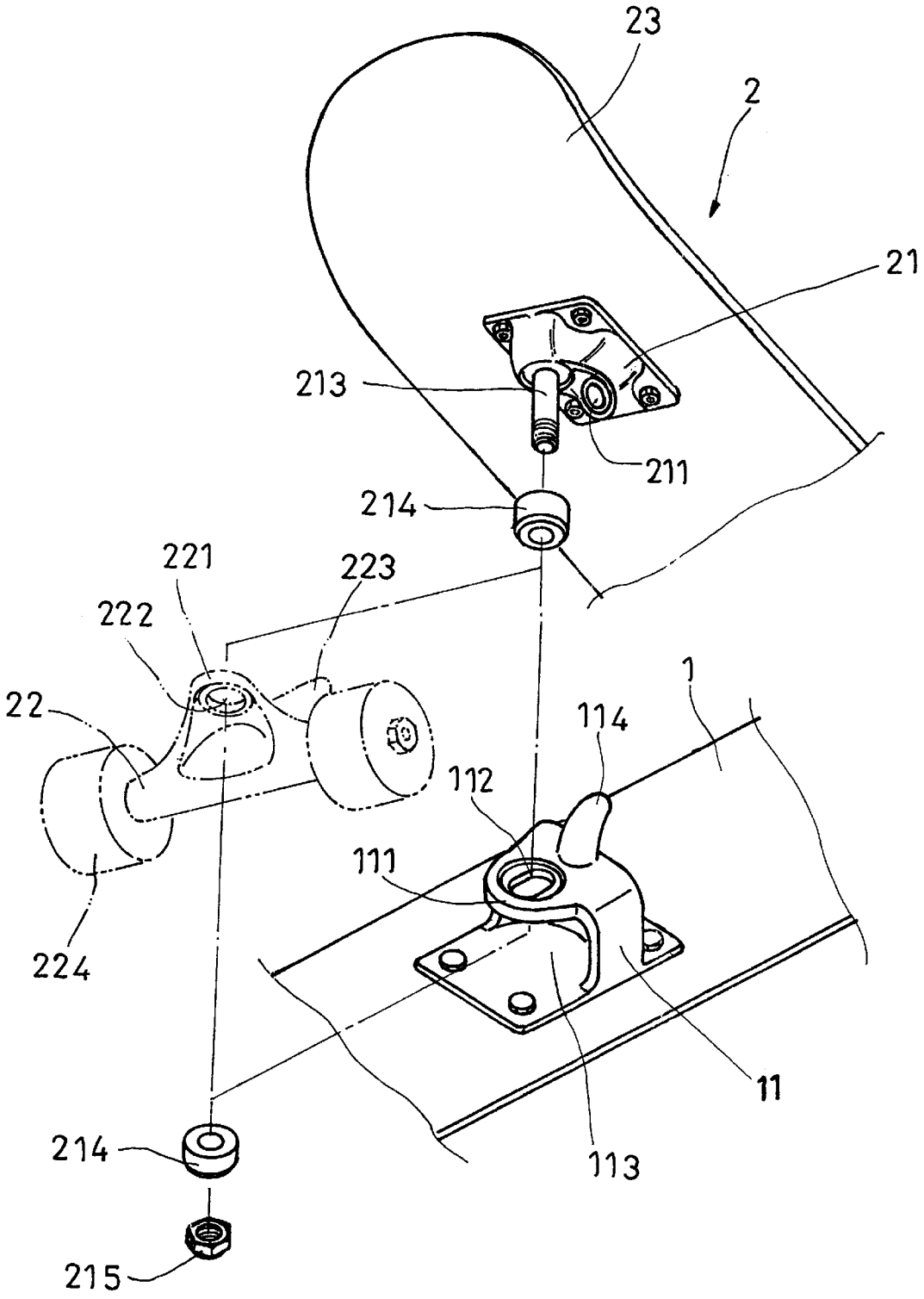
FIG. 3 is an exploded view of the present invention.
Figure 4:
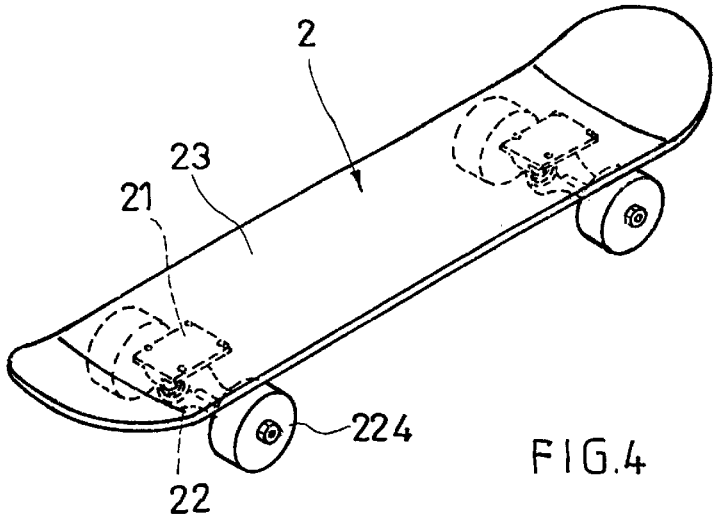
FIG. 4 is a perspective view of a skateboard according to the present invention.
Figure 6:
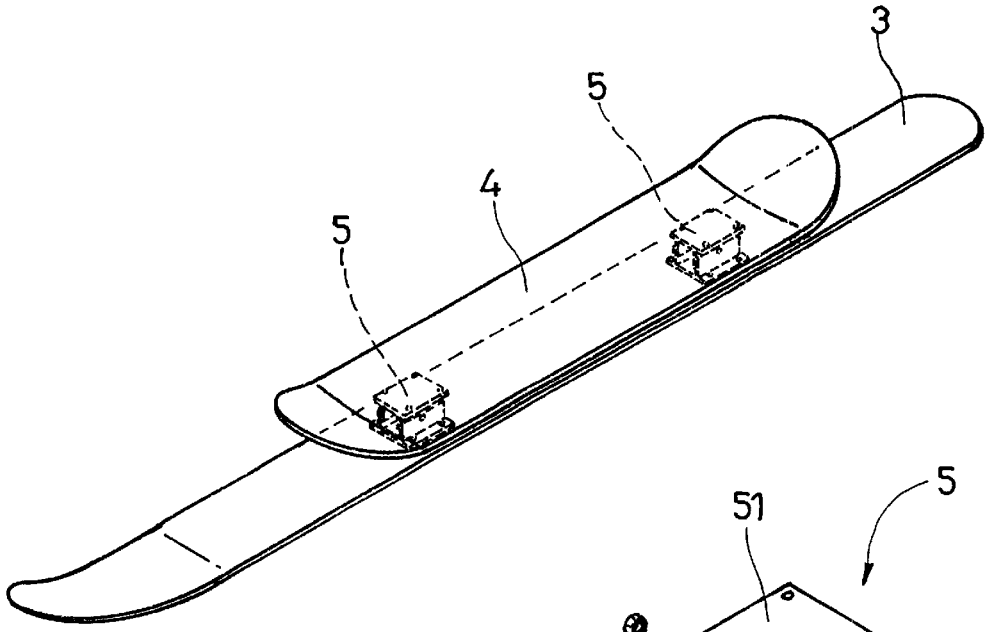
FIG.6 PRIOR ART
FIG. 6 is a perspective view of a ski according to the prior art.
Figure 7:
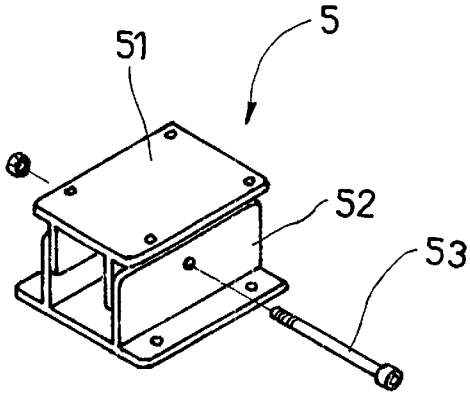
FIG.7 PRIOR ART
FIG. 7 illustrates the structure of one mounting structure of the ski according to the prior art.
Figure 5:
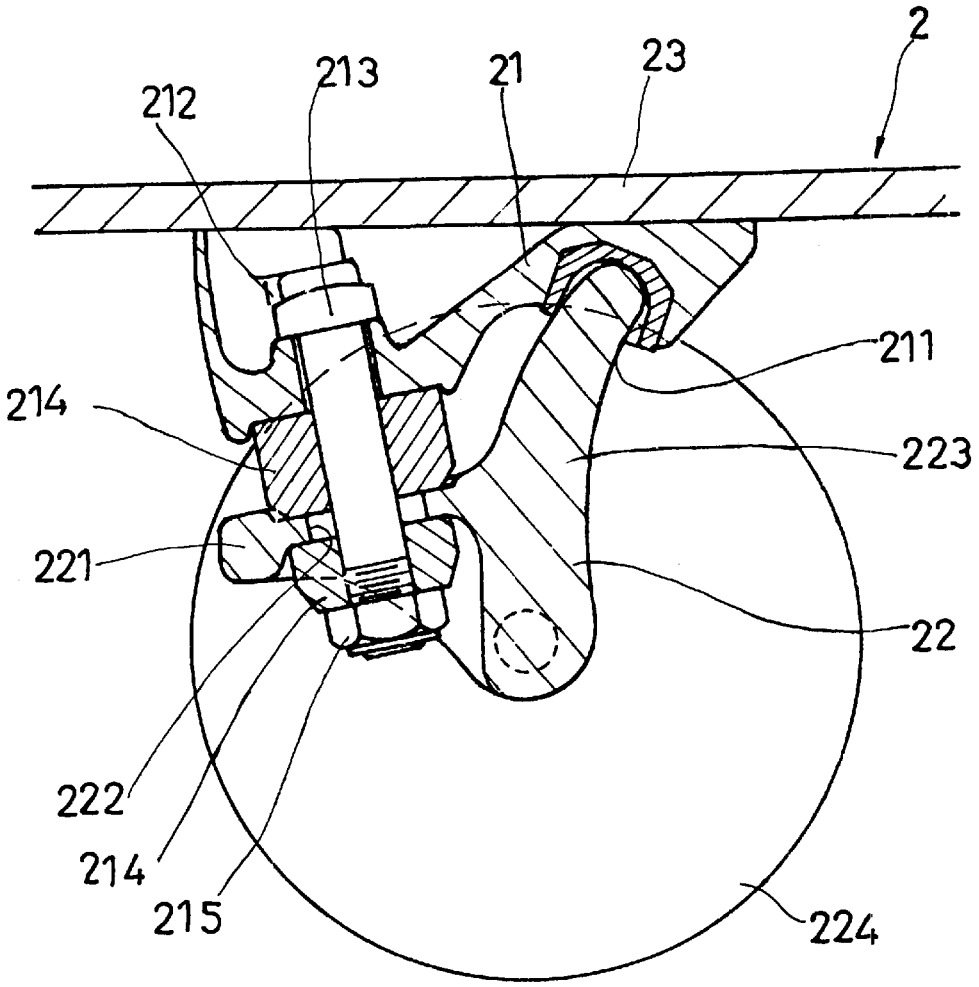
FIG. 5 is a sectional view showing one wheel assembly fastened to one riser pad of the board body according to the present invention.

Referring to FIGS. from 1 through 5, a ski 1 is showing having two mounting frames 11 (only one pivot holder is shown in the drawings). Each mounting frame 11 comprises an angled support arm 111 vertically extended upwards and then turned sideways in horizontal direction, a pivot hole 112 in the horizontal upper part of the support arm 111, and a locating rod 114 extended from the horizontal upper part of the support arm 111. The skateboard, referenced by 2, comprises a board body 23, two riser pads 21 fixedly provided at the bottom side of the board body 23 (only one riser pad is shown in the drawings). Each riser pad 21 comprises a locating hole 211 and a threaded pivot 213 for the mounting of one mounting frame 11 of the ski 1 or a wheel assembly 22 selectively. The wheel assembly 22 comprises a wheel holder 221 holding two wheels 224 at two sides, a pivot hole 222 in the wheel holder 221 between the wheels 224, and a locating rod 223 extended from a middle part of the wheel holder 221.

The mounting frame 11 can be fastened to the corresponding riser pad 21 of the board body 23 by: inserting the threaded pivot 213 of the riser pad 21 through the pivot hole 112 and the locating rod 114 into the locating hole 211, and then threading a lock nut 215 onto the threaded pivot 213 to fix the threaded pivot 213 to the mounting frame 11. Further, cushions 214 are respectively mounted on the threaded pivot 213 and secured between the riser 21 and the lock nut 215 at two sides of the support arm 111 of the mounting frame 11. Because the horizontal upper part of the support arm 111 is suspended above the base of the mounting frame 11 by a gap 113, the user can conveniently insert a wrench into the gap 113 to fasten up or loose the lock nut 215. The connection of the wheel assembly 22 to the riser pad 21 is also easy. By inserting the threaded pivot 213 through the cushions 214 and the pivot hole 222 and the locating rod 223 into the locating hole 211 and then fastening the lock nut 215 to the threaded pivot 213, the wheel assembly 22 is fastened to the riser pad 21.

The user can selectively fasten two wheel assemblies 22 or the mounting frames 11 of the ski 1 to the riser pads 21 of the board body 23. When two wheel assemblies 22 fastened to the riser pads 21 of the board body 23, the board body 23 and the wheel assemblies 22 form a skateboard for skating. When the mounting frames 11 of the ski 1 fastened to the riser pads 21 of the board body 23, the user can stand on the board body 23 to slide over snow.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A skateboard and ski arrangement comprising a board body, said board body comprising two riser pads fixedly provided at a bottom side of said board body, said riser pads each comprising a threaded pivot and a locating hole, a ski, two mounting frames fixedly provided at a top side of said ski and adapted for securing said ski to the riser pads of said board body, said mounting frames each comprising a support arm, a pivot hole disposed in said support arm and adapted for receiving the threaded pivot of one riser pad of said board body, and a locating rod extended from said support arm and adapted for plugging into the locating hole of one riser pad of said board body, two wheel assemblies adapted for fastening to said riser pads of said board body to form with said board body a skateboard, two lock nuts adapted for threading onto the threaded pivots of said riser pads of said board body to selectively secure said mounting frames or said wheel assemblies to said board body, and a plurality of cushions adapted for mounting on said threaded pivots of said riser pads between said riser pads and said lock nuts.

2. The skateboard and ski arrangement as claimed in claim 1, wherein said wheel assemblies each comprise a wheel holder, two wheels mounted on said wheel holders at two sides, a pivot hole disposed in said wheel holder and equally spaced between said wheels and adapted for receiving the threaded pivot of one riser pad of said board body, and a locating rod extended from a middle part of said wheel holder and adapted for plugging into the locating hole of one riser pad of said board body.

3. The skateboard and ski arrangement as claimed in claim 1, wherein said support arm has a horizontal upper part spaced from a base of the respective mounting frame by a gap, and the pivot hole and locating rod of each of said mounting frames are provided at the horizontal upper part of the corresponding support arm.

* * * * *